US006152769A

United States Patent [19]

Gimenes et al.

[11] Patent Number: 6,152,769

[45] Date of Patent: Nov. 28, 2000

[54] ELECTRICAL CONNECTOR SYSTEM

[75] Inventors: Jean-Paul Gimenes, Thyez; Gabriel Tupin, Vougy; Jean-Michel Giraud, Sallanches, all of France

[73] Assignee: Amphenol Socapex, France

[21] Appl. No.: 09/124,040

[22] Filed: Jul. 29, 1998

[30] Foreign Application Priority Data

Jul. 30, 1997 [FR] France ..... 97 09700

[51] Int. Cl.[7] ..... H01R 13/40

[52] U.S. Cl. ..... 439/598

[58] Field of Search ..... 439/320, 589, 439/599, 598, 903, 905, 686, 274

[56] References Cited

U.S. PATENT DOCUMENTS

| | | | |
|---|---|---|---|
| 4,039,242 | 8/1977 | Wilson | 339/177 E |
| 4,531,796 | 7/1985 | Gansert et al. | 439/589 |
| 4,764,130 | 8/1988 | DiClemente | 439/903 |
| 5,330,362 | 7/1994 | Ito et al. | 439/157 |
| 5,632,655 | 5/1997 | DeMarco, Jr. | 439/655 |
| 5,820,416 | 10/1998 | Carmichael | 439/668 |
| 6,010,348 | 1/2000 | Alden | 439/274 |

FOREIGN PATENT DOCUMENTS

| | | | |
|---|---|---|---|
| 0 039 640 | 11/1981 | European Pat. Off. | H01R 13/621 |
| 35 14 010 | 7/1986 | Germany | H01R 13/52 |

*Primary Examiner*—Steven L. Stephan
*Assistant Examiner*—Amir M Abdulmelik
*Attorney, Agent, or Firm*—Blank Rome Comisky & McCauley

[57] ABSTRACT

An electrical connector system is disclosed. This connector system includes a receptacle suitable for co-operating with a plug in which elements of the receptacle and plug are compatible with standardized connectors commonly used in industry.

12 Claims, 7 Drawing Sheets

ELECTRICAL CONNECTOR SYSTEM

FIELD OF THE INVENTION

The present invention relates to an electrical connector system.

More precisely, the invention relates to an electrical connector system constituted by a fixed portion or receptacle suitable for co-operating with a moving portion or plug, corresponding electrical conductors being wired to each of the two elements of the electrical connector.

Still more precisely, the invention relates to industrial type connector systems, in which the various elements of the two portions of the connector are compatible with standardized connectors commonly used in industry.

BACKGROUND OF THE INVENTION

With such connectors, it is desirable for the wiring of the electrical conductors to the sockets of the female portion and to the conductive pins of the male portion to be capable of being performed in a manner that is as simple as possible.

It is also desirable for the connector system to have dispositions making it possible without risk of error to mount the insulating elements of the socket and of the plug in a manner that is easily identifiable, particularly concerning the various electrical conductors connected to the terminals.

It is also desirable to have an electrical connector system in which coupling and mechanical connection between the male portion and the female portion of the connector can be performed simply and reliably so that the user is certain that electrical coupling has indeed been achieved.

It is also desirable for the two portions of the connector to be of a structure that is as simple as possible, so as to facilitate use thereof and reduce manufacturing costs.

Finally, it is desirable, particularly for the conductive sockets of the female portion, for them to be protected against any risk of mechanical damage when coupling together the male and female portions.

OBJECTS AND SUMMARY OF THE INVENTION

An object of the present invention is to provide an electrical connector system constituted by a male portion and a female portion which satisfy the main requirements specified above.

According to the invention, to achieve this object, the electrical connector system comprises:

a plug body;

a rear shell provided with means for fixing to the rear portion of the plug body;

a coupling ring mounted on the outside face of said plug body and secured in translation with the plug body;

a receptacle body provided on its outside face with thread means for co-operating with said coupling ring;

a male insulating element designed to receive conductive pins and suitable for being mounted in said receptacle body or in said plug body and provided on its rear portion with means for securing it to said plug or receptacle body; and a female insulating element designed to receive conductive sockets, comprising a rear female insulating portion and a front female insulating portion provided with means for securing it to the rear female insulating portion, said female insulating element being suitable for being mounted in said plug body or said receptacle body, said rear female insulating element being provided with means for securing it with said plug or receptacle body.

It will be understood that in particular because the female insulating element is made up of two insulating subassemblies or "portions", it is possible to obtain good protection for the conductive sockets. It will also be understood that the insulating elements are secured to the body of the plug or to the body of the receptacle by means that are simple, preferably by snap-fastening, thereby simplifying the use of such electrical connector systems.

It will also be understood that the male and female insulating elements are interchangeable relative to the body of the receptacle and the body of the plug, thereby making use of the connector system very flexible.

BRIEF DESCRIPTION OF THE DRAWINGS

Other characteristics and advantages of the invention appear more clearly on reading the following description of a preferred embodiment of the invention which is given by way of non-limiting example. The description refers to the accompanying drawings, in which.

MORE DETAILED DESCRIPTION

Figure 1:
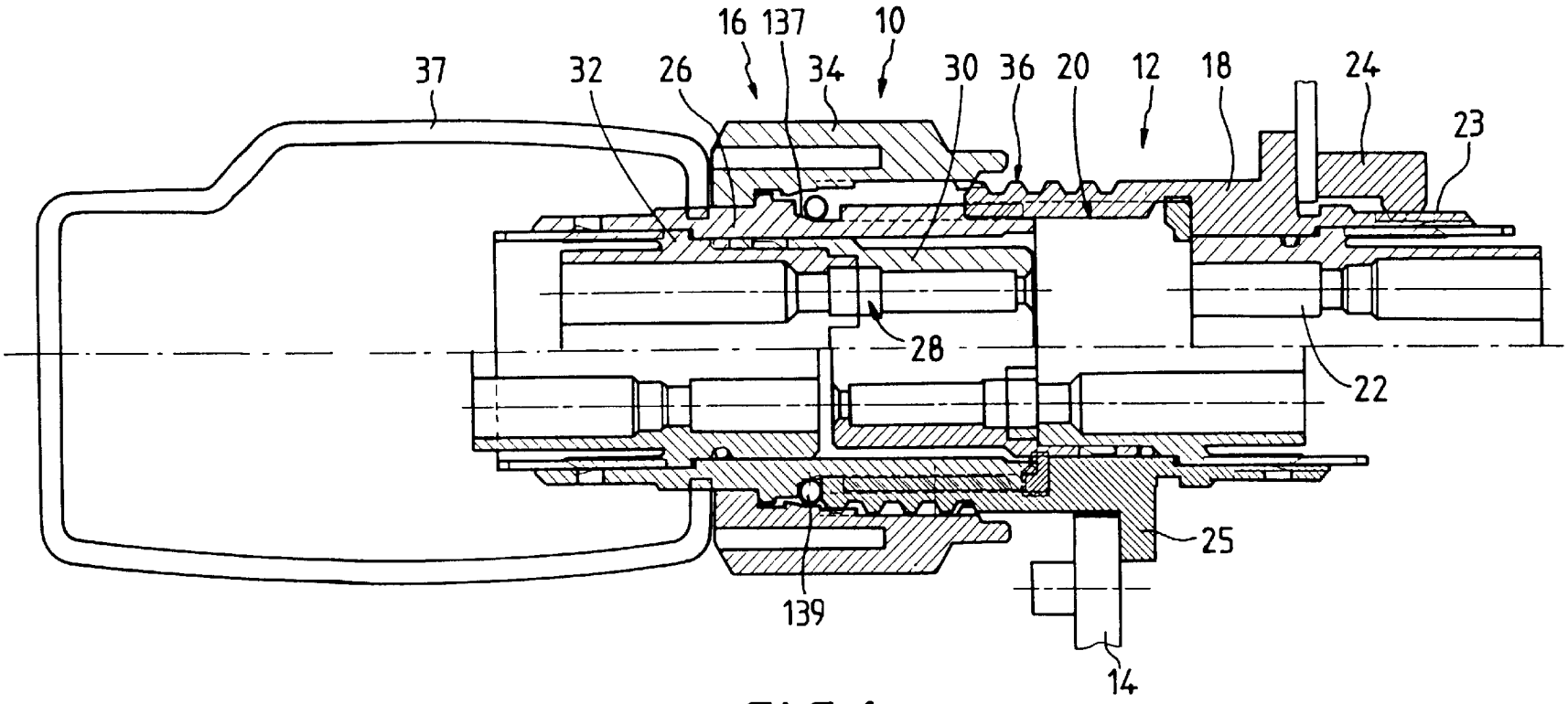
FIG. 1 is a longitudinal section showing the connector system as a whole together with its male portion and its female portion.

With reference initially to FIG. 1, the electrical connector system of the invention is described as a whole.

The electrical connector system 10 comprises firstly a receptacle 12 designed to be fixed on a panel or on any other suitable wall 14, and a removable plug 16 connected to an electric cable (not shown in the figures). The receptacle 12 is constituted by a receptacle body 18 in which there is mounted, in the particular example described, a male insulating element 20 having housings 22 formed therein to receive the male electrical contact pins. The rear outside face of the receptacle body has a thread 23 for receiving a nut 24 for fixing it to an appropriate panel. When the receptacle is fixed by means of the plate 25, the thread 23 can be used for receiving a rear shell for the receptacle.

The plug 16 comprises a plug body 26 in which a female insulating element is mounted that has overall reference 28. According to a characteristic of the invention, the female insulating element 28 is made up of two portions comprising a front female insulating portion 30 and a rear female insulating portion 32. On the outside face of the plug body 26 there is mounted a coupling ring 34 for co-operating with a thread 36 formed on the outside face of the receptacle body 18, as explained below. The electrical connector system also has a rear shell 37 which can be of any suitable type and which is fixed to the rear end of the plug body. As is well known, the rear shell 37 serves to protect the electrical conductors of the cable where they are wired to the conductive terminals of the plug, and to provide mechanical connection between the electric cable and the plug of the electrical connector system.

Figure 4:
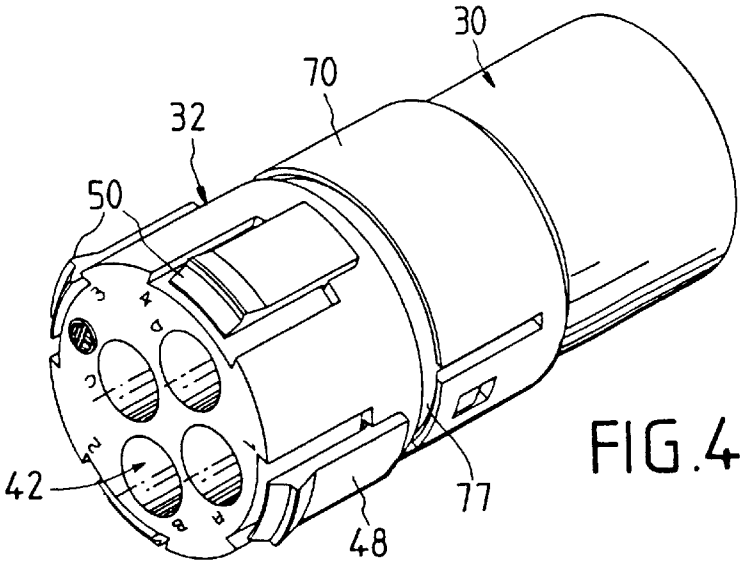
FIG. 4 is a perspective view of the assembled female insulating element.
Figure 2B:
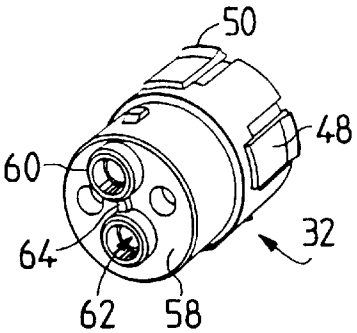
FIGS. 2A and 2B are perspective views from different points of view of the rear female insulating portion.
Figure 2A:
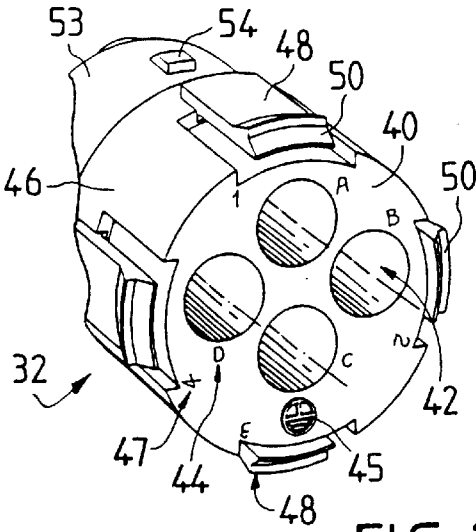

With reference below to FIGS. 2 to 4, there follows a description of a preferred embodiment of the female insulating element 28 which, as explained above, is made up of a front female insulating portion 30 and a rear female insulating portion 32.

The rear female insulating portion 32 has a rear face 40 in which housings 42 open out for receiving electrical connector sockets (not shown). As can be seen in the figure, each housing 42 is identified by a letter 44 or by a ground symbol 45. In addition, a digit referenced 47 identifies the coding of the connector. On the side face 46 of its rear end, the rear female insulating portion is provided with four resilient tongues 48 each terminating in a respective catch 50, the catches 50 being designed to co-operate with respective housings provided in the body of the plug or the body of the receptacle as explained below. The front end 53 of the rear female insulating portion has a side wall 53*a* of cylindrical shape with two snap-fastening studs 54 provided thereon. The front face 58 of the rear female insulating portion in the embodiment described has two cylindrical collars 60 and 62 which project from the front face 58 and which surround the outlets of the socket housings 42. Also preferably, these two collars are connected together by a projecting segment 64. The purpose of this relief is to increase the length of the creepage lines in the join plane between the two female insulating portions.

Preferably, the rear female insulating portion, and indeed the other insulating parts of the electrical connector system, are made by injection molding an insulating thermoplastic material which makes it possible to manufacture all of the shapes described above as single pieces.

Figure 3C:
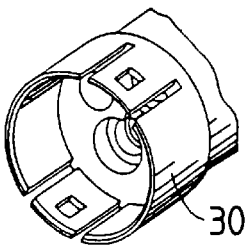
FIGS. 3A, 3B, and 3C show the front female insulating portion in perspective from the different points of view.
Figure 3B:
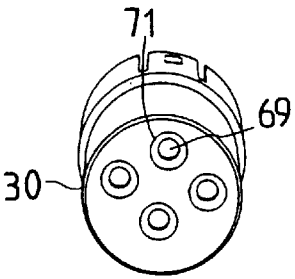
Figure 3A:
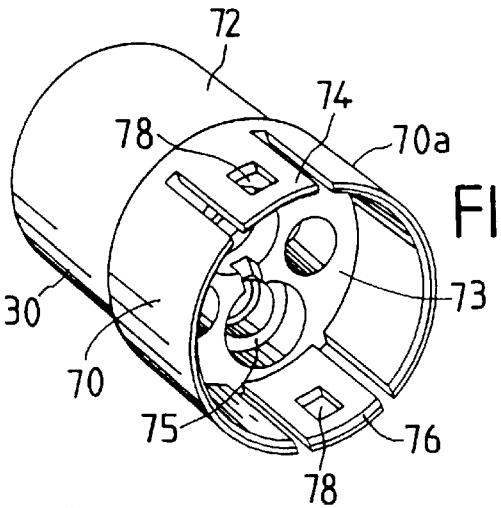

With reference below to FIGS. 3A to 3C, the front female insulating portion 30 is described. The rear end 70 of the front female insulating portion constitutes a cylindrical skirt mounted at the end of the body proper 72 of said insulating portion. The cylindrical skirt 70 is cut out to define two resilient tongues 74 and 76. Each of the tongues 74 and 76 is provided with a recess 78 for co-operating with a stud 56 of the rear female insulating portion to interconnect the two component portions of the female element. In FIG. 4, the front female insulating portion 32 and the rear female insulating portion 34 are shown assembled together by snap-fastening, as explained above. In particular, it can be seen that the side face 70*a* of the cylindrical skirt 70 defines the positioning diameter for positioning the female insulating element in the receptacle body or in the plug body, as explained below.

The rear face 73 of the front insulating portion has recesses 75 corresponding to the items in relief 62, 64, and 66 on the front face of the rear female insulating portion.

It should also be specified that the front ends of the housings 69 extending the housings 42 of the rear female insulating portion that are designed to receive the conductive sockets are of small diameter, smaller than the diameter of the sockets, thereby serving to protect the front edges of the sockets. In addition, the front ends of the housings 69 are chamfered at 71 to make it easier to insert conductive pins into the sockets.

As shown in FIG. 4, when the two female insulating portions are assembled together, they define an external annular groove 77 that is designed to receive a sealing ring.

Figure 5B:
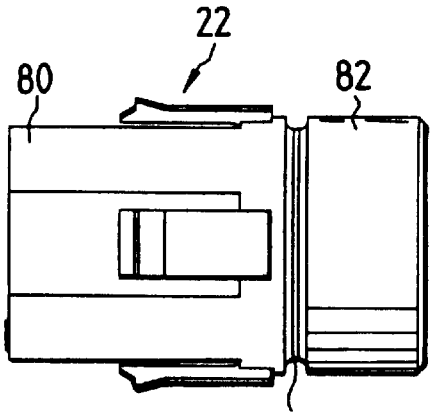
FIG. 5B is a side view of the male insulating element.
Figure 5C:
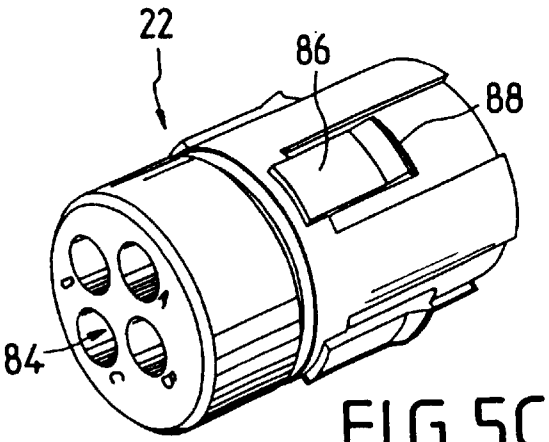
FIGS. 5A and 5C show the male insulating element in perspective, respectively showing its front face and its rear face.
Figure 5A:
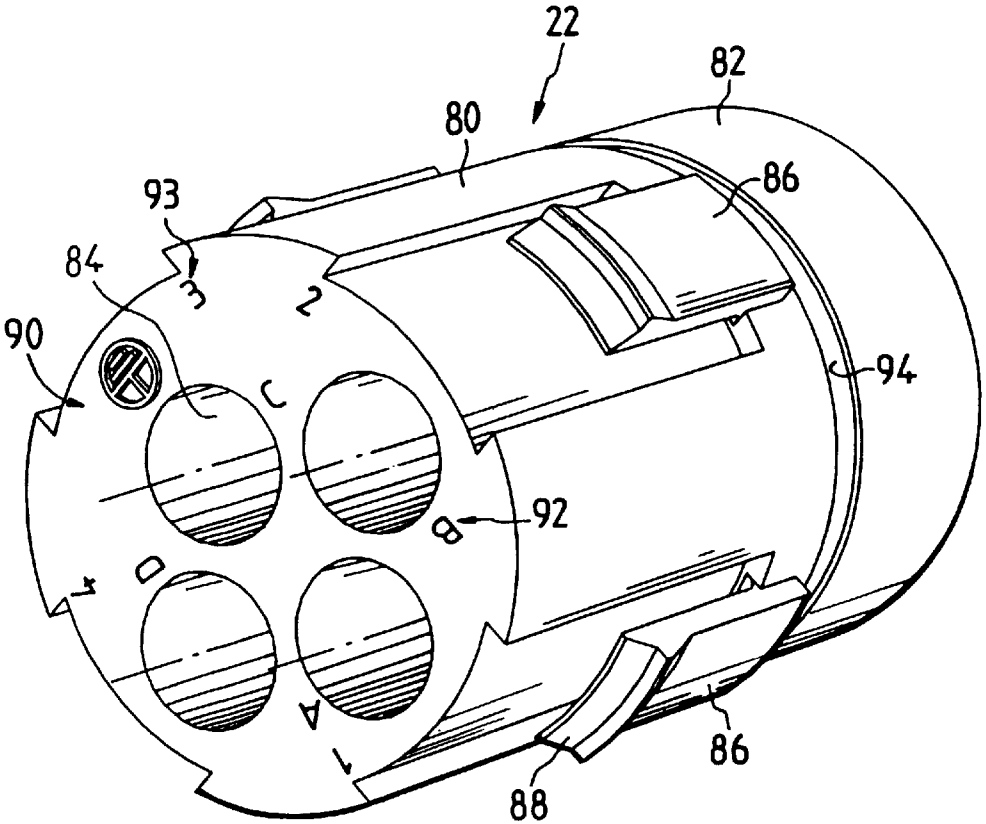

With reference below to FIGS. 5A to 5C, there is described a preferred embodiment of the male insulating element 22 which, as mentioned above, is constituted by a single piece that is preferably obtained by injection molding a thermoplastic material.

The male insulating element which is made as a single molded piece is generally cylindrical in shape and is naturally designed to be suitable for mounting in the receptacle body or in the plug body.

The cylindrical portions 80 and 82 of the side face of the male insulating element 28 define centering diameters for centering the insulating element in the plug body or the receptacle body. Naturally, the insulating element 22 is provided with housings 84 for receiving the conductive pins of the male portion of the connector. The side face of the male insulating element 22 has four resilient tongues such as 86 which are terminated by respective locking catches 88 designed, as explained below, to co-operate with housings provided in the receptacle body or the plug body. As can also be seen in the figure, the rear face 90 of the male insulating element has markings 92 identifying the various housings 84 and has code digits 93 for identifying the connector. It can also be seen that the side face of the male insulating element includes an annular groove 94 designed to receive a sealing ring to provide sealing between the insulating element and the body of the plug or the receptacle.

Figure 6B:
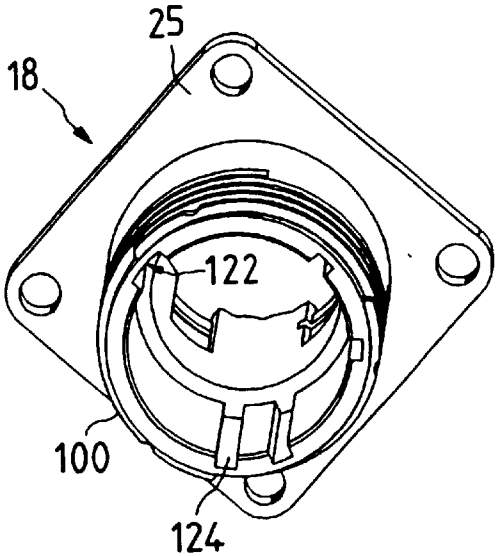
FIGS. 6A and 6B are perspective views of the body of the receptacle.
Figure 6A:
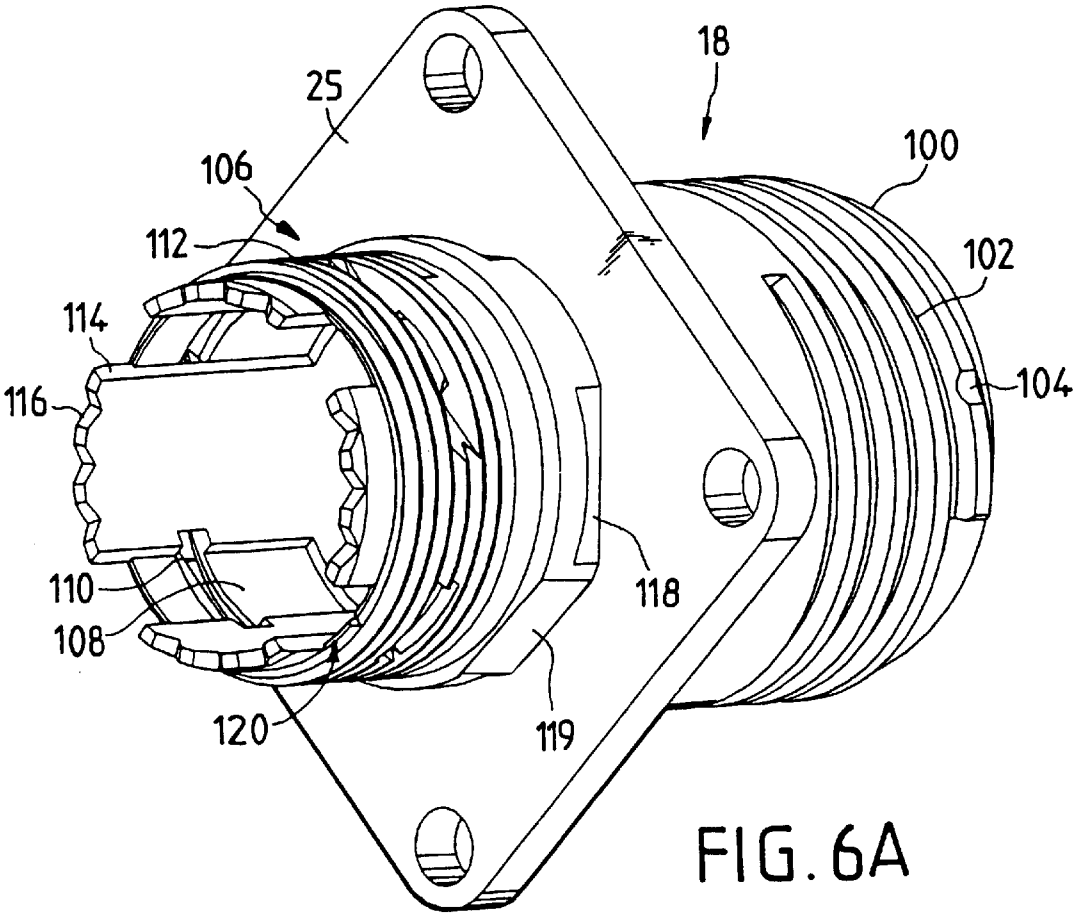

With reference below to FIGS. 6A and 6B, a preferred embodiment of the receptacle body 18 is described.

The receptacle body 18 is generally circular in shape having a cylindrical internal recess for receiving the male or female insulating element as described above. The receptacle body 18 has a front portion 100 whose outside face is provided with a thread 102 that is designed, as explained below, to co-operate with a coupling ring. The thread preferably has three equidistant notches 104 receiving the locking catch of the coupling ring.

The rear portion 106 of the receptacle body has four grooves at 90° intervals from one another referenced 108 which are designed to receive the resilient fixing tongues of the male or female insulating element inside the receptacle body. These grooves 108 are associated with windows 110 which are designed to receive the ends of the resilient tongues of the insulating elements, by forming rear abutments. In addition, these windows 110 make it possible to verify that an insulating element is properly snap-fastened to the receptacle body.

The rear portion 106 of the receptacle body also has on its outside face various fixing means for fixing to a rear shell, depending on the nature of the coupling. For example, there is a thread 112 for fixing a rear shell by means of a nut (not shown) and four tongues 114 terminating in catches 116 designed to co-operate with complementary shapes of a rear shell or of some other device. For other types of rear shell, there are also to be found fixing catches 118. These catches serve in particular to fix a rear shell of the type described below with reference to FIG. 9.

The rear portion 106 also has an indexing flat 119 that prevents the receptacle body from rotating in the panel on which the receptacle is mounted when using the coupling ring 24.

It is also important to observe that the rear portion 106 of the receptacle body has, on its periphery, a projecting index 120 for identifying angular position and making it possible, together with the code information on the various housings as described above, to position the insulating element with its conductive terminals properly positioned relative to the receptacle body.

As can be seen more easily in FIG. 6B, the inside face of the front portion 100 of the receptacle body has axial grooves such as 122 and 124 serving as engagement keys between the receptacle and the plug, the plug having corresponding ribs, as described below.

Figure 7A:
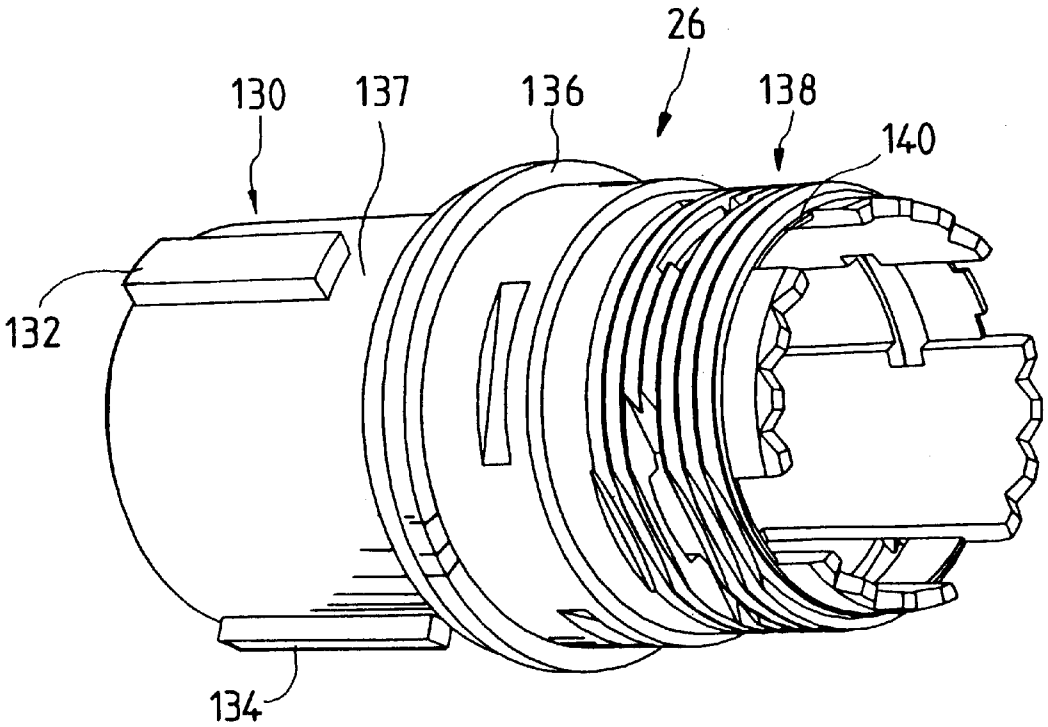
FIGS. 7A to 7C are perspective views from different angles showing the body of the plug.
Figure 7C:
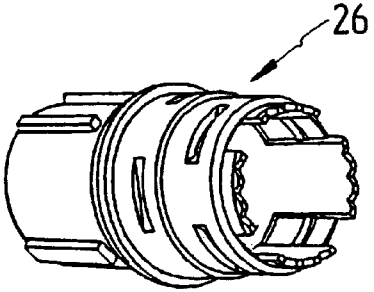
Figure 7B:
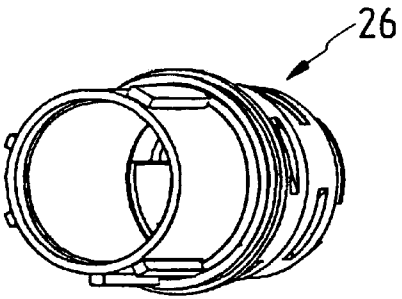

With reference below to FIGS. 7A to 7C, a preferred embodiment of the plug body 26 is described. The plug body 26 has a front portion 130 of cylindrical outside shape on which there are provided ribs such as 132 and 134 which define engagement or compatibility keys for co-operating with the grooves 122 and 124 of the receptacle. On its outside face, the plug body also has an annular collar 136 which serves as an abutment for the coupling ring, as can be seen in FIG. 1. Between the annular collar 136 and the ribs 132 and 134, there is to be found a zone 137 that is designed to receive the grounding spring (not shown) which serves to provide electrical continuity between the receptacle and the plug when these parts are assembled together. As can be seen more clearly in the upper portion of FIG. 1, this zone is frustoconical. When the receptacle and the plug are coupled together by means of the coupling ring, the front periphery of the receptacle base tends to push the spring back, away from its rest position. The conical shape causes the spring referenced 139 in FIG. 1 to expand radially, thereby providing electrical contact between the spring and the plug body in spite of the clearance which exists between the plug body and the spring when the spring is at rest. In addition, the front periphery of the receptacle body is necessarily in electrical contact with the spring 139 because of the conical shape. This ensures that electrical continuity is provided between the plug body and the receptacle body in spite of the initial clearance between the spring and the plug body, with the coupling ring naturally being made of an insulating material. The rear portion 138 of the plug body 26 is identical to that of the receptacle body as described above. It is therefore not described again. Nevertheless, it should be observed that the periphery of this rear portion 138 also has angular indexing 140 for the same purpose as that described with reference to the receptacle body.

A special tool can be used for separating the male insulating element or the female insulating element from the receptacle body or the plug body in the event of the insulating element being wrongly positioned angularly relative to the receptacle body or the plug body given the coding of the connector.

Figure 8A:
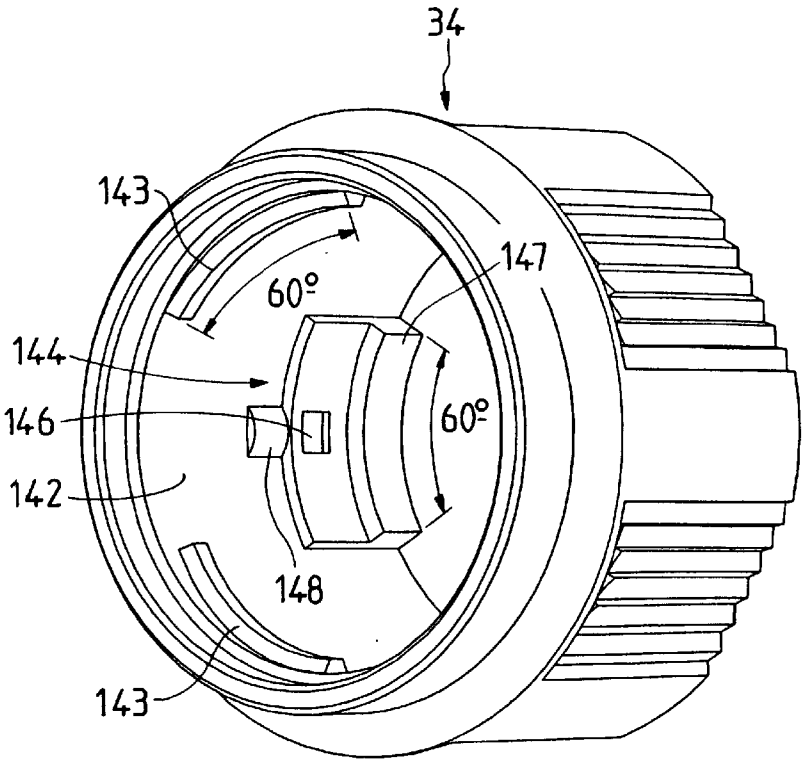
FIGS. 8A to 8C are perspective views at different angles showing the ring for coupling together the body of the receptacle and the body of the plug.
Figure 8B:
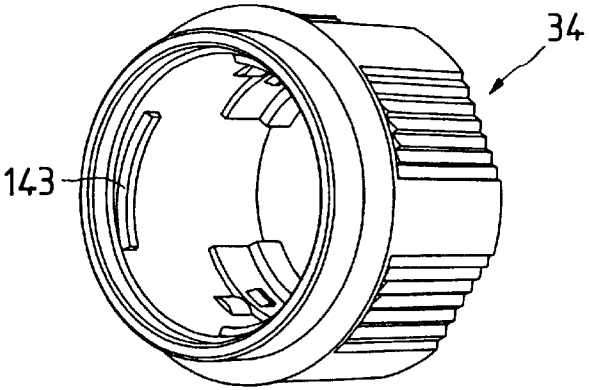
Figure 8C:
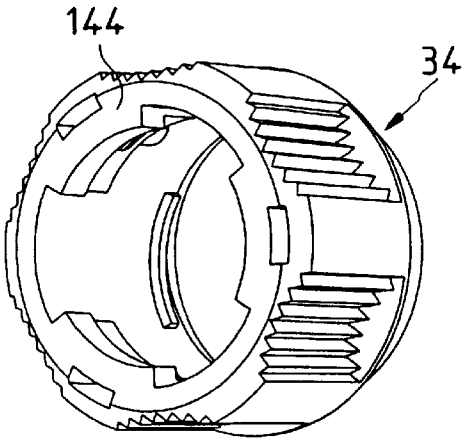

With reference below to FIGS. 8A to 8C, a preferred embodiment of the coupling ring 34 is described.

As shown better in FIG. 8A, the coupling ring 24 has three equidistant threaded sectors 143 on its circular inside face 142, each sector occupying an angle at the center that is substantially equal to 60° . These three threaded segments 143 are designed to co-operate with the thread provided on the receptacle body, referenced 36 in FIG. 1. On this inside face, there are also to be found three identical sets of relief each given reference 144, these three sets in relief likewise corresponding to an angle at the center of about 60° and being angularly offset relative to the threaded sectors 143. Each item in relief 144 has a catch 146 designed to snap-fasten the coupling ring onto the body of the plug, a guide sector 147 forming a shoulder is designed to co-operate with the annular rib 136 of the plug, and three tactile or audible locking catches 148, said catches 148 serving to ensure that the coupling ring has been properly locked onto the receptacle.

Figure 9:
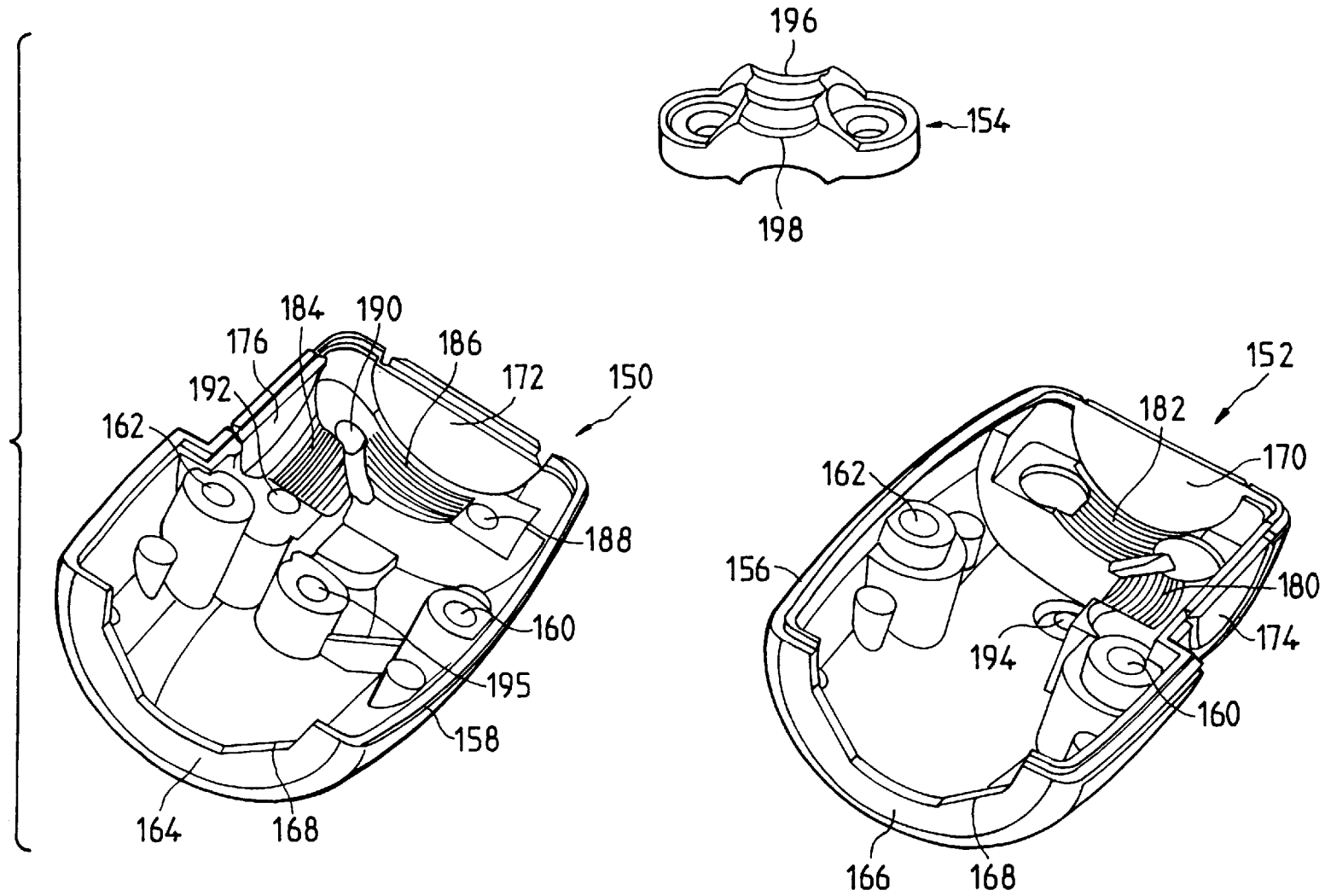
FIG. 9 is an exploded perspective view of a preferred embodiment of a rear shell for the connector system.

With reference below to FIG. 9, a preferred embodiment of the rear shell 37 is described. Nevertheless, the rear shell could naturally be of any standard type. The rear shell described with reference to FIG. 9 could naturally also be used with a different electrical connector system.

The rear shell 37 is constituted by a lower half-shell 150 and an upper half-shell 152, together with a cable fixing clamp 154. The two half-shells are united by co-operation between peripheral belts 156 and 158, and screws (not shown) engaged in the holes 160 and 162.

The fixing ends 164 and 166 of the two half-shells have respective semicircular orifices defined by flats 168 serving to locate and hold the shell assembled on the body of the receptacle or the plug.

Once the two half-shells have been assembled together, the flats are defined to exert stress on the body of the receptacle or the plug so as to encourage mechanical and electrical connections between the shells 37 and the receptacle or the plug.

The wall of each half-shell includes a first breakable half-membrane 170 and 172 disposed on the longitudinal axis of the shell 37. When these membranes are broken, the electric cable outlet is axial. The side wall of each half-shell has a second breakable half-membrane 174 and 176. These second half-membranes are disposed in a direction that is orthogonal to the axis of the shell 37. When the second half-membranes are broken, the cable outlet is at right angles relative to the axis of the coupling.

In the vicinity of each breakable half-membrane, there is a half-thread 180, 182, 184, or 186. After the appropriate half-membranes have been broken, and after the two half-shells have been assembled together, the thread that is made up of two half-threads can be used for optionally securing an accessory.

FIG. 9 shows that the lower half-shell 150 is provided with three fixing holes 188, 190, and 192 for receiving the releasable clamp 154 in register with the broken half-membrane so as to hold the electric cable mechanically to the shell 37.

The back of the upper half-shell 152 advantageously includes a breakable membrane 194. After the two half-shells 150 and 152 have been assembled together and onto the body of the plug or the receptacle, and after the membrane 194 has been broken, it is possible to inject an insulating potting compound into the volume defined by the two half-shells so as to seal the assembly made in this way.

In the back of the lower half-shell 150 there is a blind hole 195 for fixing a ground or earth conductor wire.

Also preferably, the releasable fixing clamp 154 has catches 198 on its portion in the form of a portion of a cylindrical surface 196 designed to come into contact with the cable, the catches serving to improve cable retention.

What is claimed is:

1. An electrical connector system comprising:

a plug provided with a body having a rear portion and an outside face;

a rear shell provided with means for fixing to the rear portion of the plug body;

a coupling ring having an inner surface provided with thread means, said coupling ring being mounted on the outside face of said plug body and secured in translation with the plug body;

a receptacle provided with a body having an outside surface provided with thread means for co-operating with the thread means on the inner surface of said coupling ring;

a male insulating element designed to receive conductive pins and suitable for being mounted in said receptacle body or in said plug body and having a rear portion provided with means for securing it to said plug or receptacle body; and a female insulating element designed to receive conductive sockets, comprising a rear female insulating portion having a front face and a separate front female insulating portion having a rear face and being provided with means for securing said rear face of said front female insulating portion to the front face of the rear female insulating portion to join the rear female insulating portion to the front female insulating portion, said female insulating element being suitable for being mounted in said plug body or said receptacle body, said rear female insulating element being provided with means for securing it with said plug or receptacle body.

2. An electrical connector system according to claim 1, wherein the means for securing the rear female insulating portion to the front female insulating portion, and the means for securing the male and female insulating elements with the plug or receptacle bodies are snap-fastening means.

3. An electrical connector system according to claim 2, wherein the male and female insulating elements are made of thermoplastic material, and wherein the snap-fastening means comprise elastically deformable tongues that are integrally formed with said insulating elements.

4. An electrical connector system according to claim 1, wherein said front female insulating portion has a plurality of housings for receiving conductive sockets, and wherein the front portion of each housing opening out into the front face of the front female insulating portion has a smaller diameter than the diameter of the corresponding electrical socket.

5. An electrical connector system according to claim 4, wherein the front face of the front female insulating portion is provided with chamfers associated with the ends of the conductive socket housings opening out into said front face.

6. An electrical connector system according to claim 1, wherein the rear face of the front female insulating portion or the front face of the rear female insulating portion is provided with a plurality of annular collars projecting from said face and surrounding the open ends of at least some of the housings for said sockets, and wherein the other one of said two faces is provided with corresponding annular recesses.

7. An electrical connector system according to claim 1, wherein the rear face of the male insulating element and the rear face of the rear female insulating portion are provided with means for identifying each socket and pin housing, and wherein the periphery of the rear end of the plug body and of the receptacle body is provided with an angle-identifying index.

8. An electrical connector system according to claim 7, wherein the front face of the front female insulating portion is provided with means for identifying the various housings for conductive sockets.

9. An electrical connector system according to claim 1, wherein said coupling ring has on its inside face a plurality of discontinuous threaded sectors suitable for co-operating with a thread formed on the outside face of the front end of the receptacle body.

10. An electrical connector system according to claim 1, wherein said rear shell comprises two assembled-together half-shells.

11. An electrical connector system according to claim 10, wherein the wall of each half-shell has a first breakable half-membrane disposed orthogonally to a second breakable half-membrane.

12. An electrical connector system according to claim 1, wherein the outside face of said plug body has a frustoconical portion suitable for receiving an annular spring, said spring being pushed back against said frustoconical surface by the front periphery of the receptacle body when the receptacle body and the plug body are coupled together using said coupling ring.

* * * * *